United States Patent [19]

Varin

[11] 4,190,923

[45] Mar. 4, 1980

[54] APPLIANCES FOR CLEANING VARIOUS TYPES OF FLOORS BY SUCTION OR MOTORIZED BEATING OR BRUSHING

[75] Inventor: Michel A. Varin, Crepy en Valois, France

[73] Assignee: Société Anonyme dite: Etablissements Georges Olivier, Paris, France

[21] Appl. No.: 857,251

[22] Filed: Dec. 5, 1977

[30] Foreign Application Priority Data

Dec. 16, 1976 [FR] France ..... 76 37947
Jul. 28, 1977 [FR] France ..... 77 23295

[51] Int. Cl.[2] ..... A47L 5/30
[52] U.S. Cl. ..... 15/383; 15/412
[58] Field of Search ..... 15/363, 377, 383, 388–392, 15/412

[56] References Cited

U.S. PATENT DOCUMENTS

| | | | |
|---|---|---|---|
| 1,483,974 | 2/1924 | Hoover | 15/377 X |
| 3,266,078 | 8/1966 | Brown et al. | 15/377 X |
| 3,354,496 | 11/1967 | Jonsson | 15/377 |

FOREIGN PATENT DOCUMENTS

| | | | |
|---|---|---|---|
| 2018667 | 10/1971 | Fed. Rep. of Germany | 15/390 |
| 2124071 | 11/1972 | Fed. Rep. of Germany | 15/388 |
| 2295723 | 12/1974 | France | 15/377 |

*Primary Examiner*—Edward L. Roberts
*Attorney, Agent, or Firm*—Poms, Smith, Lande & Rose

[57] ABSTRACT

An appliance for cleaning various types of floors by suction and motorized beating or brushing, has several operational members or elements including a rotary brush or beater, a motor (electrical, mechanical, or turbine) for rotating the brush, and at least one suction channel connecting the brush housing to a pivoting connection which attaches to an external suction source. The various operational members or elements are all integrally mounted onto or formed within a single molded platform which forms the body of the appliance. The assembled platform then becomes the single operational element of the appliance and allows direct access to the functional members or elements. The platform is covered with a protective cover and attaches to a sliding or rolling base plate.

19 Claims, 15 Drawing Figures

APPLIANCES FOR CLEANING VARIOUS TYPES OF FLOORS BY SUCTION OR MOTORIZED BEATING OR BRUSHING

BACKGROUND AND BRIEF SUMMARY OF THE INVENTION

The present invention relates to improvements made to appliances for cleaning various types of floors and carpets by suction and motorized beating or brushing.

A principal object of the invention is to integrate all the operational members of the appliance into a single molded platform or frame whose function is to support these members. As a result the assembly is easy, rapid and reliable.

Additionally, the aesthetic appearance results from providing a cover or protective member, which protects and covers the platform. The cover can be shaped without difficulty by various techniques. In particular, it can be made by the pressure molding of an inexpensive plastic material which, although subject to considerable shrinkage, is not likely to cause any defects or deformation because the cover has no internal ribs.

For the same reason the thickness of the protecting member can be considerably reduced, which would allow the cover and frame to be from different plastic materials (for example, polyethylene and polypropylene). As a result, the cost of the appliance can be competitive compared with that of an appliance utilizing only one type of plastic.

Moreover, from the technical and economic standpoints there is no reason why the outside appearance of the appliance should not be diversified in order to differentiate different brands. It is merely necessary to have different molds for making the protective member. The molds could be simple and relatively inexpensive.

A further object of the invention is to improve the outflow of air containing various particles in the suction channel even though the channel is merely a passage in the frame. The design of the appliance makes this flow non-turbulent with a minimal pressure drop so that the particles (dust, debris, pieces of thread or wall etc.) are rapidly discharged and consequently there is little risk of them blocking the channel. Thus, the cleaning efficiency is improved.

A further object of the invention is to facilitate the unblocking of the channel by making the inside of it accessible although it is integrated into the platform.

The appliance comprises various operational elements or members: a rotary brush or beater, a motor (electrical, mechanical, or turbine) for rotating the brush, at least one suction channel connecting the brush housing to a pivoting connection which can be connected to a suction source.

In order to achieve these objects and in accordance with the invention, the various operational members or elements, no matter whether they are molded in one piece or joined together, are integrated into a single platform which forms the body of the appliance. The assembled platform has a certain autonomy of operation and there is direct access to the operational members or elements. The platform is covered by a simple protective cover and attaches to a sliding or rolling base plate.

Moreover, the suction channel is constituted by a U-shaped formation in the platform in accordance with the contour chosen for connecting the pivoting connection to the brush housing. The open formation in the platform is sealed by an auxiliary member whose profile reduces the cross-section of the channel in order to accommodate differing channel designs.

For housing the brush the appliance has a trough molded in the platform which contacts the floor by means of an elongated opening below the trough in the base plate. Furthermore, the trough wall extends up to the vicinity of the space in which the brush moves. The suction channel connects to the trough through a window in the vertical rear wall of the trough.

The base plate can have a suction slot located to the rear of the elongated opening provided for the passage of the brush. The suction channel then connects to the slot through a horizontal window made in the base plate near the slot. Moreover, at least one orifice can be provided in the base plate to establish a connection between the suction slot and the brush housing formed in the frame, thereby allowing the suction in the brush housing to assist in removing particles in the slot.

The above-indicated auxiliary member can contain a vertical passage extending from the substantially horizontal window to the suction channel. This passage can be sleeved in order to regulate its cross-section and thus the amount of suction applied to the horizontal window.

The base plate forms a ridge which separates the suction slot from the trough which houses the brush.

The vertical passage can be sealed with a plug, in which case the ridge then has at least one cut-out establishing a restricted passage at ground level between the suction slot and the trough housing the brush.

The peripheral edges of the platform and cover are fixed to one another by means of screws. A C-shaped shock-absorbing belt or bumper is mounted on the edges and covers the attaching screws in order to conceal them, thus making disassembly of the cover by the user difficult.

BRIEF DESCRIPTION OF THE DRAWINGS

Other features and advantages of the invention can be gathered from the following description of embodiments with reference to the drawings.

DETAILED DESCRIPTION OF THE EXEMPLARY EMBODIMENT

Normally the cleaning appliance is fitted to the end of a rigid tube forming a sleeve of a vacuum cleaner.

According to the embodiment shown in FIGS. 1 to 10 and as can be gathered more particularly from FIGS. 2 to 5, the appliance comprises three separate parts, namely a platform 1 in which is formed or on which is mounted most of the operational elements or members for suction and brushing, a protective cover 2 covering the platform and giving the appliance its aesthetic appearance, and a sliding or rolling base plate 3 fixed beneath the platform, by which the appliance rests on the floor to be cleaned.

Figure 3:
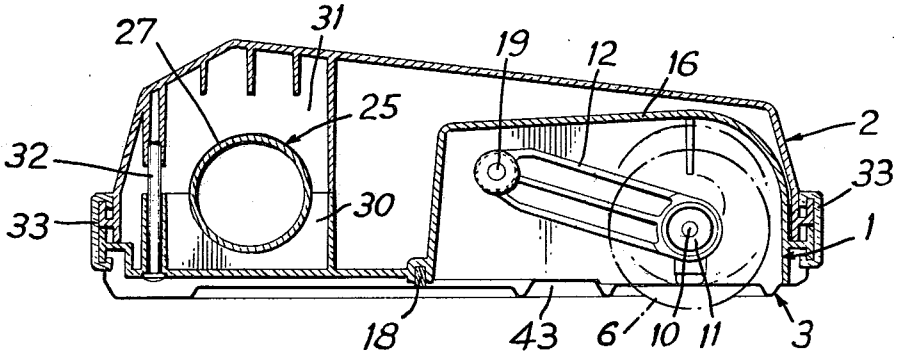
FIGS. 3, 4 and 5 show cross-sectional views taken progressively along the midsection of the appliance through planes III—III, IV—IV and V—V of FIG. 1, respectively.

The front platform 1 has a U-shaped transverse trough 4 (FIG. 4) connected to the outside via an elongated opening 5 (FIGS. 4 and 10) made in base plate 3. A brush 6 is housed in the trough in the vicinity of the walls thereof but is able to both rotate (FIG. 4) and move substantially vertically (FIG. 3).

Figure 1:
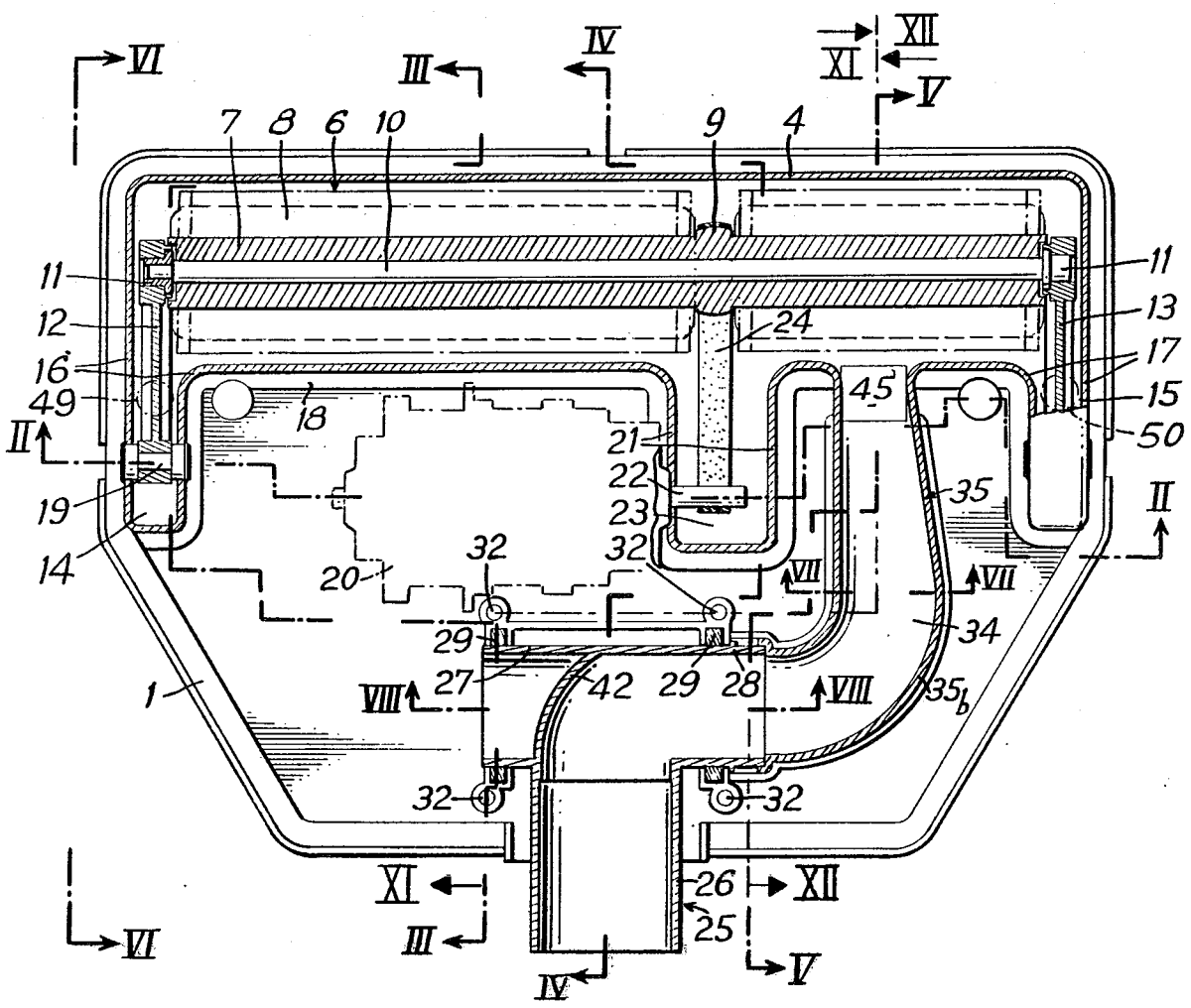
FIG. 1 is a plan view, partly in section, taken from above along the plane I—I of FIG. 2, illustrating an embodiment of the appliance according to the invention, the belt and cover being removed.
Figure 4:
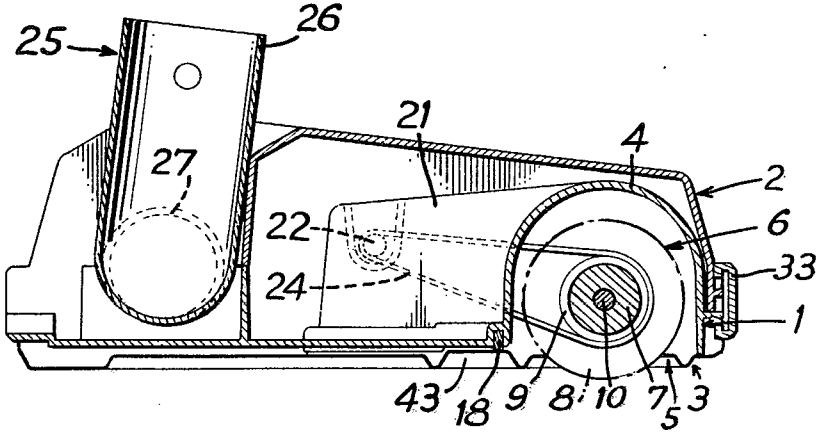

Brush 6 is cylindrical and has an axial tubular core 7 to which are attached bristles 8. In its substantially median zone (FIG. 1) the core has a pulley 9 which connects brush 6 with a motor 20 by means of belt drive 24 (FIGS. 1 and 4).

Core 7 of the brush is threaded onto a coaxial rod 10 provided with end fittings 11 gripped and supported by the free ends of independent levers 12, 13 extending in planes perpendicular to the axis of the brush in recesses 14,15 (FIGS. 1 and 3) defined by platform walls 16,17. The platform walls extend at right angles and towards the rear of the platform from the rear walls of trough 4 in such a way that recesses 14,15 connect to the ends of the trough. Thus, the trough and the recesses constitute a single cavity which is open at the bottom and molded into frame 1. In addition, this single cavity which in plan view has the shape of a double U is partially closed at the bottom by base plate 3 which bears directly against the cavity walls and via a joint 18 (FIG. 3). Communication with the outside of the structure is provided solely by the opening 5 of the base plate at the brush location point.

Each lever 12 or 13 is pivoted by its end opposite to the brush about a spindle 19 (FIGS. 1 and 3) traversing walls 16 and 17 of recesses 14 and 15. Thus, brush 6 floats and can rise or fall, optionally at an angle, in order to follow unevennesses of the floor surface.

Brush 6 is motorized and to this end pulley 9 is connected by belt drive 24 to a motor which can be electrical, mechanical (by taking the movement from the wheels on the base plate) or turbine (operated using the vacuum cleaner itself).

In the represented embodiment an electric motor 20 (FIG. 1) is used. The rear wall of trough 4 has two other walls 21 projecting away from it and forming an inner cavity projecting rearwards from the trough as shown in FIGS. 1 and 4. Motor 20 is fixed to one wall 21 of the cavity and its output shaft 22 penetrates recess 23. An endless belt 24 connects pulley 9 of brush 6 to shaft 22 and extends into the recess.

Figure 8:
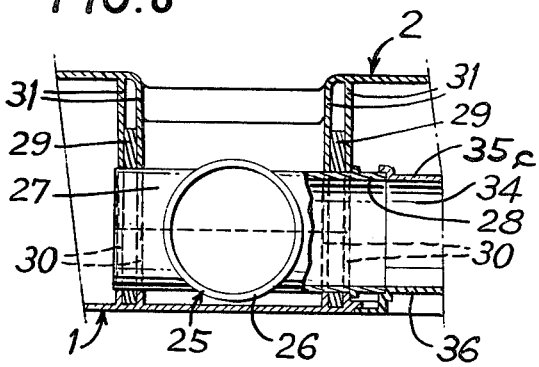

Moreover, and as can be gathered more clearly with reference to FIGS. 1, 3, 4, 5, 6 and 8, platform 1 is equipped with a pivoting connection 25. This connection is T-shaped and has on the one hand a median tube 26 for connection to the tubular suction sleeve and two aligned lateral tubes 27,28. The tubes 27,28 are able to pipe the particle-charged air from the suction channel to the vacuum cleaner, and they also constitute coaxial pivoting members which permit the pivoting of the connection when the appliance is working on the ground. To this end tubes 27,28 are surrounded by annular gaskets 29 (FIGS. 1 and 8) securely held by lower half-bearings 30 and upper caps 31 which cover or overlap one another and are fixed respectively to platform 1 and cover 2 (FIGS. 3 and 8). Four screws 32 ((FIGS. 1 and 3) maintain the caps in engagement with the half-bearings. To complete the assembly of the cover on the platform, a C-shaped shock-absorbing belt or bumper 33 is mounted on the peripheral edges of the platform and cover (FIG. 3).

Figure 11:
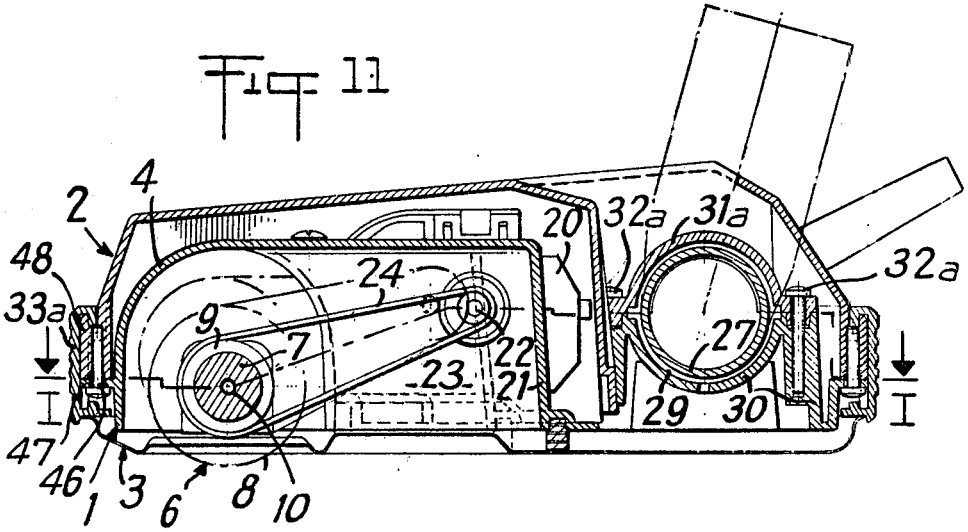
FIG. 11 is a cross-sectional view of the midsection of the appliance taken along plane XI—XI of FIG. 1 and shows an alternative embodiment of the appliance.

According to an alternative embodiment illustrated in FIG. 11, the caps 31*a* are independent of cover 2 and are fixed to the half-bearings 30 by means of four screws 32*a* (FIG. 11). Thus, the cover is free from internal ribs and its thickness can be minimum and uniform, thus facilitating the molding of the cover to whatever aesthetic shape is desired.

To bring about the assembly of cover 2 to the fully-assembled platform 1, screws 46 engage edges 47,48 of the platform and cover. Moreover, the C-shaped shock-absorbing belt 33*a* is mounted on the edges and covers the heads of the above-mentioned screws masking them from view. This makes it very difficult to find how to dismantle the appliance which discourages the user from attempting to inspect or repair the equipment. According to the embodiment of FIGS. 1 to 10, connection 25 routes the external suction (FIGS. 1, 2, 5, 7, 8 and 9) through its lateral tube 28 to brush trough 4 by means of suction channel 34.

Figure 2:
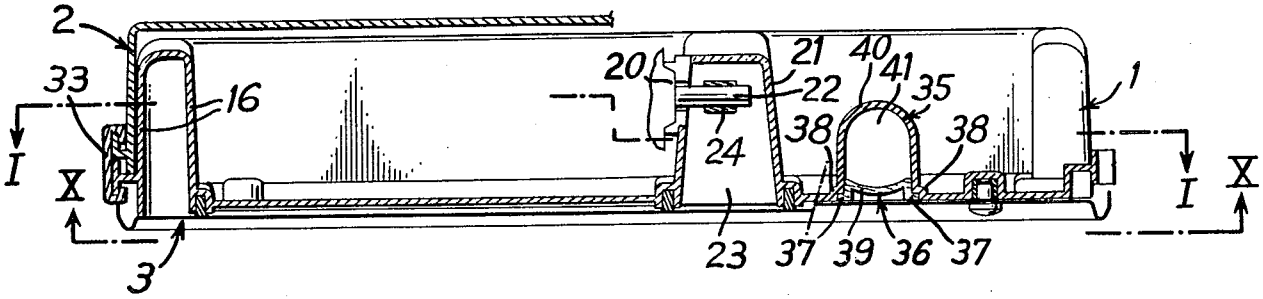
FIG. 2 is a cross-section taken along the midsection of the exemplary embodiment of the present invention through plane II—II of FIG. 1.
Figure 9:
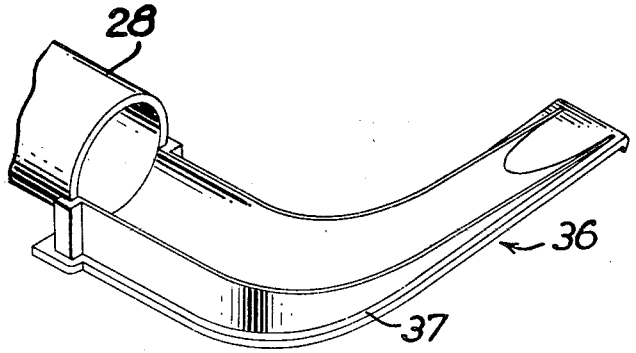
FIG. 9 is a perspective view of the suction channel auxiliary member.
Figure 5:
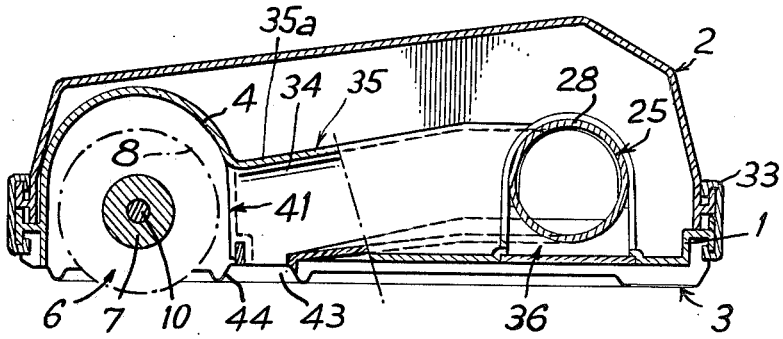
Figure 6:
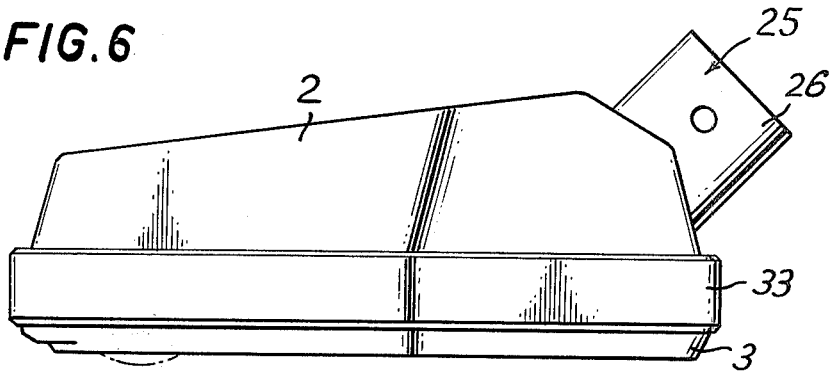
FIG. 6 is a longitudinal elevation along the plane VI—VI of FIG. 1.
Figure 7:
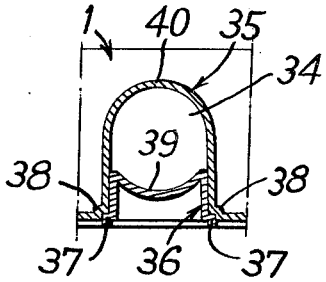
FIGS. 7 and 8 show detail progressive end views, partially in section, of the pivoting connection at the rear of the appliance and taken respectively through plane VII—VII and VIII—VIII of FIG. 1.

This channel comprises a U-shaped wall 35 molded in platform 1. The channel is open at the bottom (FIGS. 2, 5 and 7). Between trough 4 and tube 28 it has a slightly inclined straight portion 35*a* (FIG. 5), a bend 35*b* with a large radius of curvature (FIG. 1) and a substantially horizontal transverse straight portion 35*c* (FIG. 8), whereby it connects to tube 28. The channel is formed above base plate 3.

Channel 34 is also defined by an auxiliary member 36 mounted beneath it in order to seal it and define its cross-section. The height of the auxiliary member defines the chosen cross-section of the channel. In the embodiment shown in perspective in FIG. 9 and in cross-sectional form in FIGS. 2, 5, and 7, member 36 comprises a U-shaped member which is fitted between the open walls 35 of channel 34 and consequently has a complementary outline, profile and slope to that of channel 34. The lateral flanges of member 36 are thus brought into contact with those of walls 35 until an edge 37 of the member abuts against the peripheral shoulders 38 of the channel. Moreover, upper surface 39 of member 36 is curved inwards in such a way that its concavity is opposite to that of inner surface 40 of channel 34.

In the selected embodiment, the auxiliary member 36 is detachable from channel 34 so that it is merely necessary to disconnect the member from the channel in order to obtain access to the channel and the pivoting connection for unblocking and cleaning the same.

It is also possible for member 36 to be fixed to base plate 3 and thereby be placed in the channel during the fitting of the base plate to the platform 1.

The cross-section of the suction channel 34, defined by its side walls 35 as well as by surface 39 of auxiliary member 36, is substantially circular (FIGS. 2, 7 and 5). Moreover, this cross-section increases progressively towards the suction source, i.e. from trough 4 up to the median tube 26 of connection 25.

Moreover, suction channel 34 issues into trough 4 via a substantially vertical window 41 (FIGS. 2 and 5). Moreover, in the preferred embodiment in which there is only one such channel 34, the lateral tube 27 of connection 25 is sealed by an inwardly curved deflector 42 (FIG. 1), whose curvature extends from the median tube 26 to lateral tube 28. Like the rounded cross-section of channel 34, and the increasing progression of this cross-section, the deflector aids the flow of air containing the particles removed during the cleaning operation.

Obviously, the appliance can have two such suction channels connected from the trough to the two lateral tubes 27,28 of connection 25, in which case there is no deflector 42.

Moreover, and as can be gathered from FIGS. 3, 4, 5 and 10, the elongated base opening 5 provided for the passage of brush 6 can be coupled with a conventional suction slot 43, the latter being located to the rear and separated from the opening by a ridge 44 forming a sliding shoe.

Figure 10:
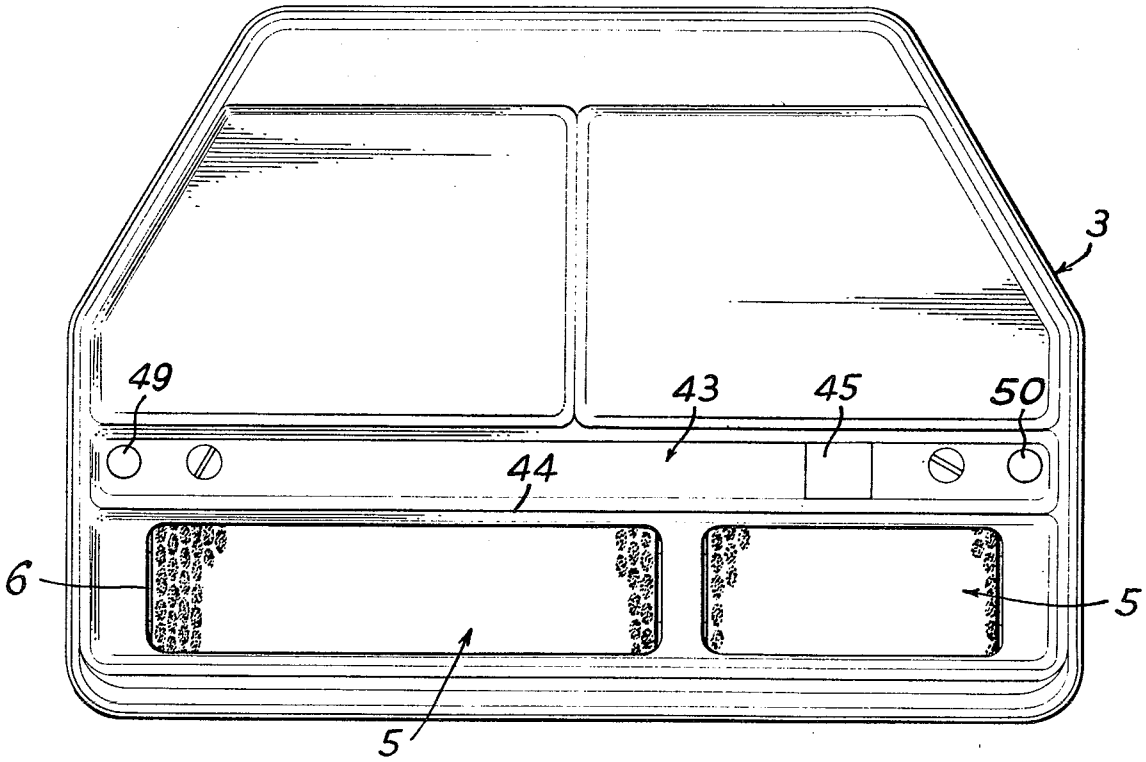
FIG. 10 shows a plan view taken through plane X—X of FIG. 2.

Referring now to FIGS. 1 and 10, it can be seen that the suction channel 34 issues into slot 43 through a horizontal window 45 made between the end of auxiliary member 36 and trough 4 near that portion of base plate 3 which constitutes the bottom of slot 43.

In this embodiment, the sum of the cross-sections of the vertical and horizontal windows 41 and 45 respectively, is at the most equal to the minimum cross-section of connection 25.

Moreover, it may be advantageous for two orifices 49,50 to be made in the suction slot 43 of the base plate for issuing into recesses 14,15 of the platform to slot 43 in such a way that a passage is established between slot 43 and trough 4.

Figure 12:
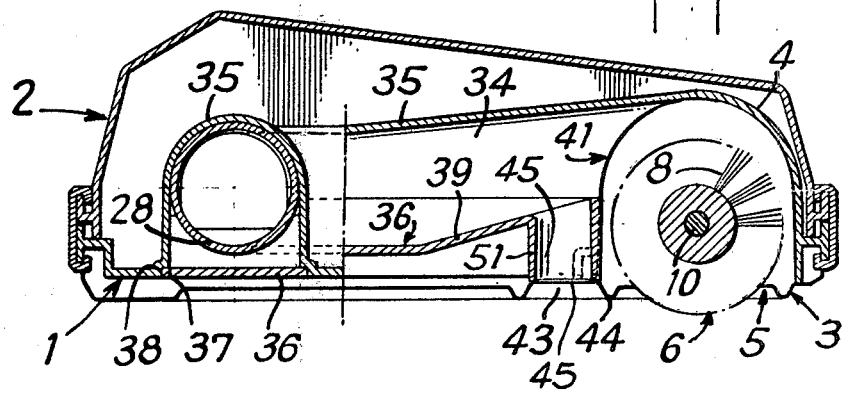
FIGS. 12 and 13 are cross-sectional views of another alternative embodiment of the present invention taken along plane XII—XII of FIG. 1.

According to the alternative embodiment illustrated by FIG. 12, the cross-sections of the lateral window 41 and the horizontal window 45 can be regulated relative to one another and relative to the cross-section of channel 34 in order to control the distribution of the suction flow between the brush housing 4 and slot 43. To this end the surface 39 of auxiliary member 36 gently slopes upward in order to reduce the height of lateral window 41. The end of the surface forms a sleeve 51 extending to base plate 3 and defining a passage connecting channel 34 to horizontal window 45.

This reduction of the cross-section of lateral window 41 linked with the increase in the cross-section of the horizontal window 45 can be total, in which case the lateral window 41 is completely sealed by an inwardly curved flap extending from sleeve 51.

Figure 13:
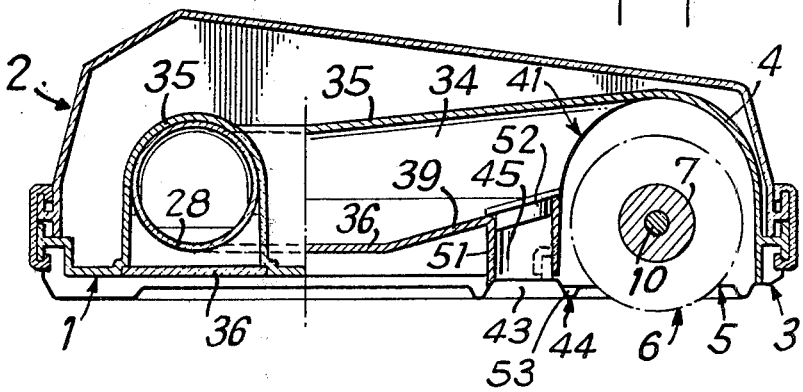

However, it may prove advantageous to adopt the alternative embodiment shown in FIG. 13 according to which sleeve 51 is sealed by a plug 52 and a cutout 53 is made in ridge 44. Under these conditions suction in slot 43 is established via the cutout to trough 4 and suction in the trough is established via lateral window 41 to channel 34.

Obviously, suction in the slot can be accentuated and regulated by providing one or more calibrated holes in plug 52.

Figure 15:
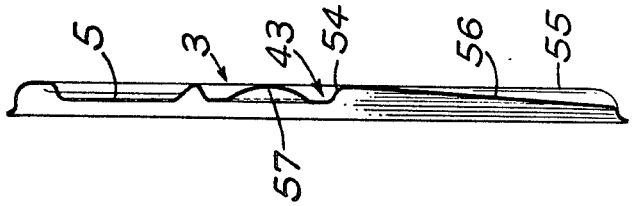
FIG. 15 shows a cross-sectional view of the appliance taken along the plane XV—XV of FIG. 14.
Figure 14:
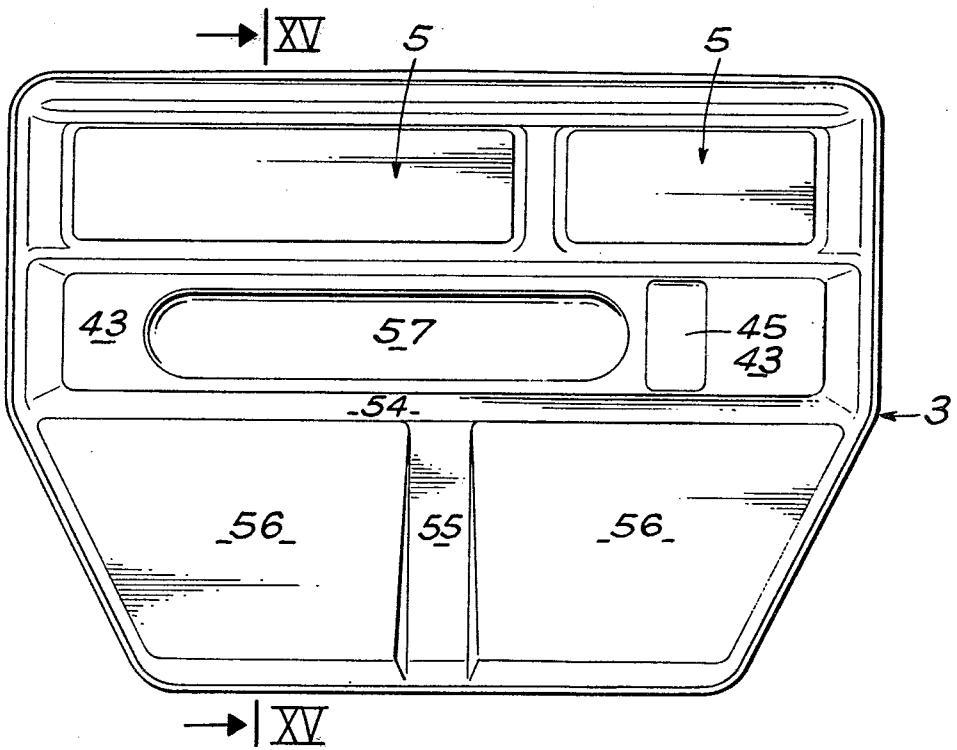
FIG. 14 shows a plan view from below of the appliance and an alternative embodiment of the base plate.

Moreover, in order to decrease the resistance to the forward movement of the appliance, it is desirable to reduce the floor contact surface of base plate 3 and to give the latter the shape illustrated in FIGS. 14 and 15. The rear trapezoidal portion of the base plate located to the rear of slot 43 has a transverse rectilinear bearing surface 54 and a median longitudinal rectilinear bearing surface 55 extending in the form of a T relative to one another. The remaining lateral areas 56 of the base then have a rising gradient (5° to 6° for example) from the front to the rear so that in this direction these areas are progressively raised from the floor.

Moreover, the bottom of slot 43 has a sliding shoe 57 which projects in accordance with its axis and over part of its length. The shoe is rounded in the front to rear direction and at its ends. The apex thereof is flush with the other bearing surface of the base, thereby improving sliding of the base plate at the slot location, and permitting a peripheral circulation within the slot of the sucked-in air.

The invention is not limited to the embodiments described and represented hereinbefore and various modifications can be made thereto without passing beyond the scope of the invention.

I claim:

1. In an appliance for cleaning floors and carpets by a combination of suction and motorized brushing having a rotating brush for brushing and beating the floor, a brush housing containing the brush, a motor connected to the brush for rotating the brush, channel means, extending from adjacent of the brush housing to a source of suction connected to the appliance, for routing the particles dislodged from the floor by the brush and the suction to the source of suction, and connecting means, adjacent to the downstream end of the channel means, for pivotally attaching the appliance to the suction source, the improvement comprising:

a platform containing surfaces for integrally mounting the brush, the motor, and the connecting means, with a portion of the platform forming the channel means and the brush housing;

a protective cover attached to the platform and being free of contact with the brush, the motor, the channel means, and the connecting means;

and a sliding base plate attached to the platform and being free of contact with the brush, the motor, the channel means, and the connecting means.

2. The appliance according to claim 1 wherein the channel means comprises a U-shaped channel molded into the platform in accordance with the contour chosen for connecting the connecting means to the brush housing, and an auxiliary member located in the U-shaped channel for forming a portion of the channel and for reducing the profile of the channel in order to achieve a chosen cross-section.

3. The appliance according to claim 2, wherein the auxiliary member is detachably mounted within the channel.

4. The appliance according to claim 2, wherein the auxiliary member is fixed to the sliding base plate.

5. The appliance according to claim 1, wherein the channel means has a substantially circular cross section.

6. The appliance according to claim 1, wherein the cross-section of the channel means increases progressively toward the connecting means.

7. The appliance according to claim 1, wherein the brush housing includes a rear wall, and a window through the rear wall for passing the particles and suction from the brush housing to the channel means.

8. The appliance according to claim 7 wherein the appliance further comprises a suction slot, located in the base plate behind an elongated opening provided in the plate for the brush, and means for connecting the channel means to the slot.

9. The appliance according to claim 8, wherein the base plate comprises at least one orifice means, located in the base plate, for routing part of the suction from within the brush housing to the slot.

10. The appliance according to claim 9, wherein the platform forms a pair of cavities, extending rearward to the slot from each side of the brush housing, for mounting levers for supporting the brush, the orifice means extending through the platform at the cavities for routing suction from the cavities to the suction slot.

11. The applicance according to claim 8 wherein the base plate comprises a ridge for separating the slot from the brush opening.

12. The appliance according to claim 8, wherein the means for connecting the channel means to the slot comprises a sleeve attaching to the auxiliary member and extending from the channel means to the slot, the sleeve being partially closed at its end closest to the slot, thereby regulating the suction passing through the sleeve.

13. The appliance according to claim 12, wherein the appliance further comprises means for sealing the sleeve, and passage means, located in the base, for routing suction to the slot from the brush housing.

14. The appliance according to claim 8, wherein the apparatus further comprises a sliding shoe projecting through the slot, for supporting the appliance and for permitting free circulation of air into the slot.

15. The appliance according to claim 1, wherein the connecting means comprises T-shaped tubing means for routing the particles in the channel means to the suction source, means connecting the top of the T to the channel means, and means connecting the lower end of the T to the suction source.

16. The appliance according to claim 15, wherein the channel means attaches to one of the upper ends of the T-shaped tubing means, and the other tubing means comprises inwardly-curved deflection means for sealing the other upper-end of the tubing means and for aiding the flow of particles from the channel means to the suction source.

17. The appliance according to claim 15, further comprising tube attaching means, mounted on the platform, for attaching the top ends of the T-shaped tube to the platform, thereby eliminating any structure in the cover which would otherwise be necessary to support the T-shaped tube.

18. The appliance according to claim 1, wherein the base plate comprises a transverse bearing surface and at least one longitudinal surface, thereby allowing the remaining portions of the base to be raised above these surfaces.

19. The appliance according to claim 1, further comprising means for attaching the platform to the cover along their peripheries, and for concealing the attaching means and for simultaneously absorbing shocks encountered by the appliance while in use.

* * * * *

UNITED STATES PATENT AND TRADEMARK OFFICE

CERTIFICATE OF CORRECTION

PATENT NO. : 4,190,923

DATED : March 4, 1980

INVENTOR(S) : Michel A. Varin

It is certified that error appears in the above-identified patent and that said Letters Patent are hereby corrected as shown below:

Column 8, line 26 (within claim 18), after the word "longitudinal" insert --bearing--.

Signed and Sealed this

*Twenty-fourth* Day of *June 1980*

[SEAL]

*Attest:*

SIDNEY A. DIAMOND

*Attesting Officer*

*Commissioner of Patents and Trademarks*